US011697544B2

(12) United States Patent
Gu et al.

(10) Patent No.: US 11,697,544 B2
(45) Date of Patent: Jul. 11, 2023

(54) INSULATING BEVERAGE CONTAINER

(71) Applicant: Frost Buddy LLC, Newton, IL (US)

(72) Inventors: Weiliang Gu, Shenzhen Shi (CN); Rui Cao, Shenzhen Shi (CN)

(73) Assignee: Frost Buddy LLC, Newton, IL (US)

( * ) Notice: Subject to any disclaimer, the term of this patent is extended or adjusted under 35 U.S.C. 154(b) by 46 days.

(21) Appl. No.: 17/514,310

(22) Filed: Oct. 29, 2021

(65) Prior Publication Data

US 2022/0177217 A1 Jun. 9, 2022

(30) Foreign Application Priority Data

Dec. 8, 2020 (CN) ..... 202022914941.X
Aug. 18, 2021 (CN) ..... 202121939044.2

(51) Int. Cl.
*B65D 81/38* (2006.01)

(52) U.S. Cl.
CPC ..... *B65D 81/3876* (2013.01)

(58) Field of Classification Search
CPC .... A47J 41/00; A47J 41/0055; A47J 41/0072; A47J 41/0077; A47J 41/02; A47J 41/022; A47J 41/028; B65D 81/38; B65D 81/3876; B65D 81/3881; B65D 81/3865; B65D 81/3869
See application file for complete search history.

(56) References Cited

U.S. PATENT DOCUMENTS

| | | | | |
|---|---|---|---|---|
| 6,419,108 | B1 * | 7/2002 | Toida | A47G 19/2288 220/592.27 |
| 8,544,678 | B1 | 10/2013 | Hughes | |
| D761,618 | S * | 7/2016 | Lapsker | D7/392.1 |
| 10,717,587 | B2 | 7/2020 | Tarbutton | |
| 10,773,873 | B2 | 9/2020 | Callinan et al. | |
| 11,414,258 | B2 * | 8/2022 | Jacob | A47J 41/0038 |
| 2009/0071969 | A1 * | 3/2009 | Lopez | A47G 19/22 220/592.17 |
| 2018/0242765 | A1 | 8/2018 | Rane et al. | |
| 2019/0274457 | A1 * | 9/2019 | Robertson | A47J 31/005 |

FOREIGN PATENT DOCUMENTS

| | | |
|---|---|---|
| CN | 113273869 | 8/2021 |
| EP | 3662797 | 6/2020 |
| JP | 2019043640 | 3/2019 |

OTHER PUBLICATIONS

ISA/EPO, Examiner Fitterer, "Search Report and Written Opinion," 13 pgs. dated Mar. 16, 2022.

* cited by examiner

*Primary Examiner* — Javier A Pagan
(74) *Attorney, Agent, or Firm* — Dentons Bingham Greenebaum LLP; Brian W. Chellgren

(57) ABSTRACT

A multi-purpose insulating beverage container includes an outer container with an open upper end, a removable inner container configured for insertion into the outer container via the open upper end, and a cover adapted to engage the outer container and retain the inner container within the outer container. The inner container includes a plurality of annular side ledges with decreasing diameters sized to support beverage bottles or cans of different sizes.

14 Claims, 20 Drawing Sheets

INSULATING BEVERAGE CONTAINER

CROSS-REFERENCE TO RELATED APPLICATIONS

This application claims the benefit of priority to Chinese patent application serial No. 2021219390442, filed Aug. 18, 2021, for MULTI-FUNCTIONAL VACUUM INSULATED CONTAINER and Chinese patent application serial No. 202022914941X, filed Dec. 8, 2020, for MULTI-FUNCTIONAL VACUUM INSULATED CONTAINER, incorporated herein by reference.

FIELD OF THE INVENTION

A multi-purpose insulating beverage container includes an outer container with an open upper end, a removable inner container configured for insertion into the outer container via the open upper end, and a cover adapted to engage the outer container and retain the inner container within the outer container. The inner container includes a plurality of annular side ledges with decreasing diameters sized to support beverage bottles or cans of different sizes.

BACKGROUND OF THE INVENTION

Insulating beverage containers are widely used to provide thermal insulation for beverage cans or bottles. Typical known insulating beverage containers partially enclose the beverage can or bottle while leaving the top portion of the can or bottle exposed, allowing the user to drink from the exposed open top of the can or bottle. Such beverage containers are typically sized to accommodate a standard 12 oz. beverage can or a standard 12 oz. beverage bottle. However, beverages are also provided in smaller diameter slim cans or in larger diameter 16 oz. beverage cans, 16 oz. beverage bottles, or 16.9 oz. soda bottles. A need exists for a single, multi-purpose, insulating beverage container capable of partially enclosing and insulating beverage cans or bottles of a variety of diameters and heights.

SUMMARY

It is the object of the present invention to provide a multi-purpose insulating beverage container capable of accommodating beverage cans or bottles of a variety of diameters and heights. The insulating beverage container is further capable of serving as a container for beverages itself, and is configured for using in preparing filtered beverages, such as tea. In some embodiments, an insulating beverage container includes an outer container having, an interior bottom, an inner wall extending peripherally around the interior bottom and terminating in an open upper end, an exterior bottom spaced from the interior bottom, and an outer wall extending peripherally around the exterior bottom and spaced from the inner wall to define an insulating space between the inner wall and outer wall and terminating at the open upper end; an inner container removably nested within the outer container through the open upper end, the inner container having a bottom and a side extending peripherally around the bottom and terminating in an open top end; and a cover removably attached to the upper end; wherein the side includes an upper portion, an intermediate portion, and a lower portion, wherein the lower portion of the side has a smaller diameter than the intermediate portion of the side, and wherein the intermediate portion of the side has a smaller diameter than the upper portion of the side; and wherein the side includes an annular first side ledge formed between the upper portion of the side and the intermediate portion of the side, and an annular second side ledge formed between the intermediate portion of the side and the lower portion of the side.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim. Each embodiment described herein is not necessarily intended to address every object described herein, and each embodiment does not necessarily include each feature described. Other forms, embodiments, objects, advantages, benefits, features, and aspects of the present invention will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

A better understanding of the present invention will be had upon reference to the following description in conjunction with the accompanying drawings.

DETAILED DESCRIPTION OF THE PREFERRED EMBODIMENTS

Figure 1A:
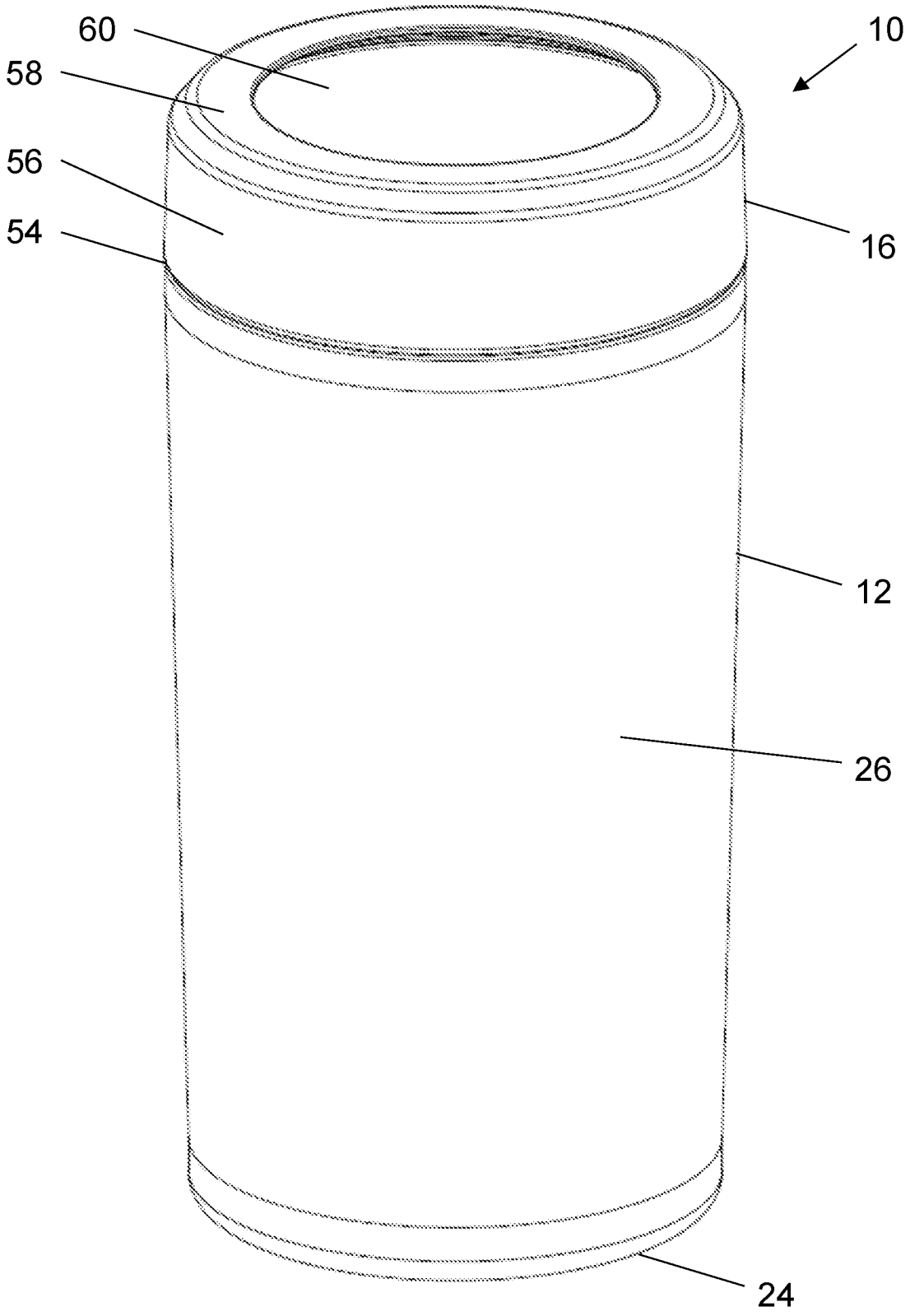
FIG. 1A is a side perspective view of a first embodiment of an insulating beverage container.
Figure 1B:
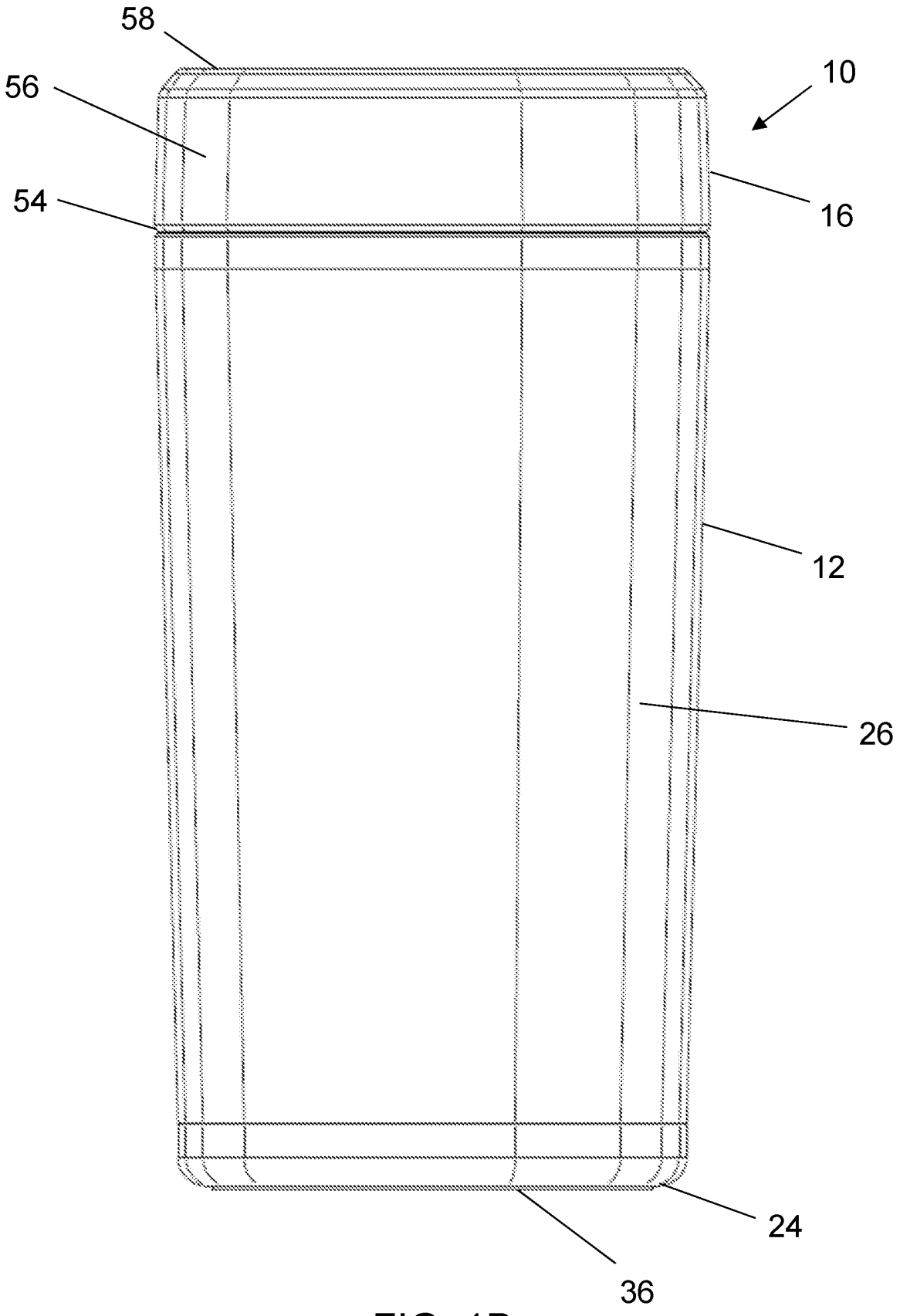
FIG. 1B is a side view of the first embodiment.
Figure 1C:
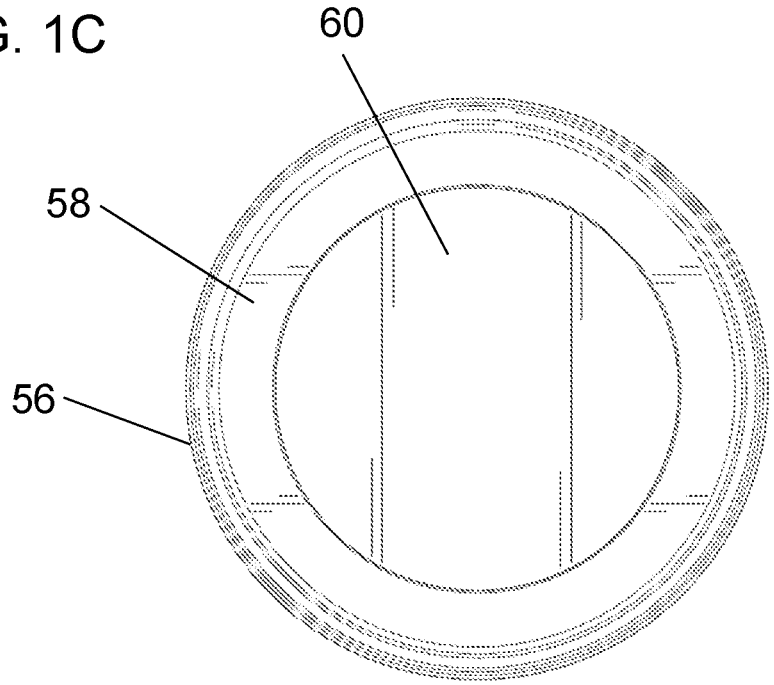
FIG. 1C is a top view of the first embodiment with the inner container omitted.
Figure 1D:
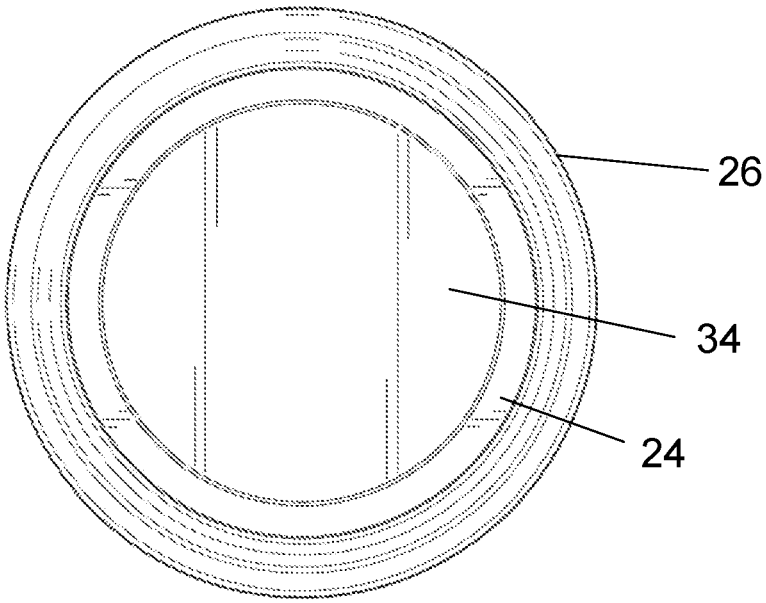
FIG. 1D is a bottom view of the first embodiment with the resilient base omitted.
Figure 2:
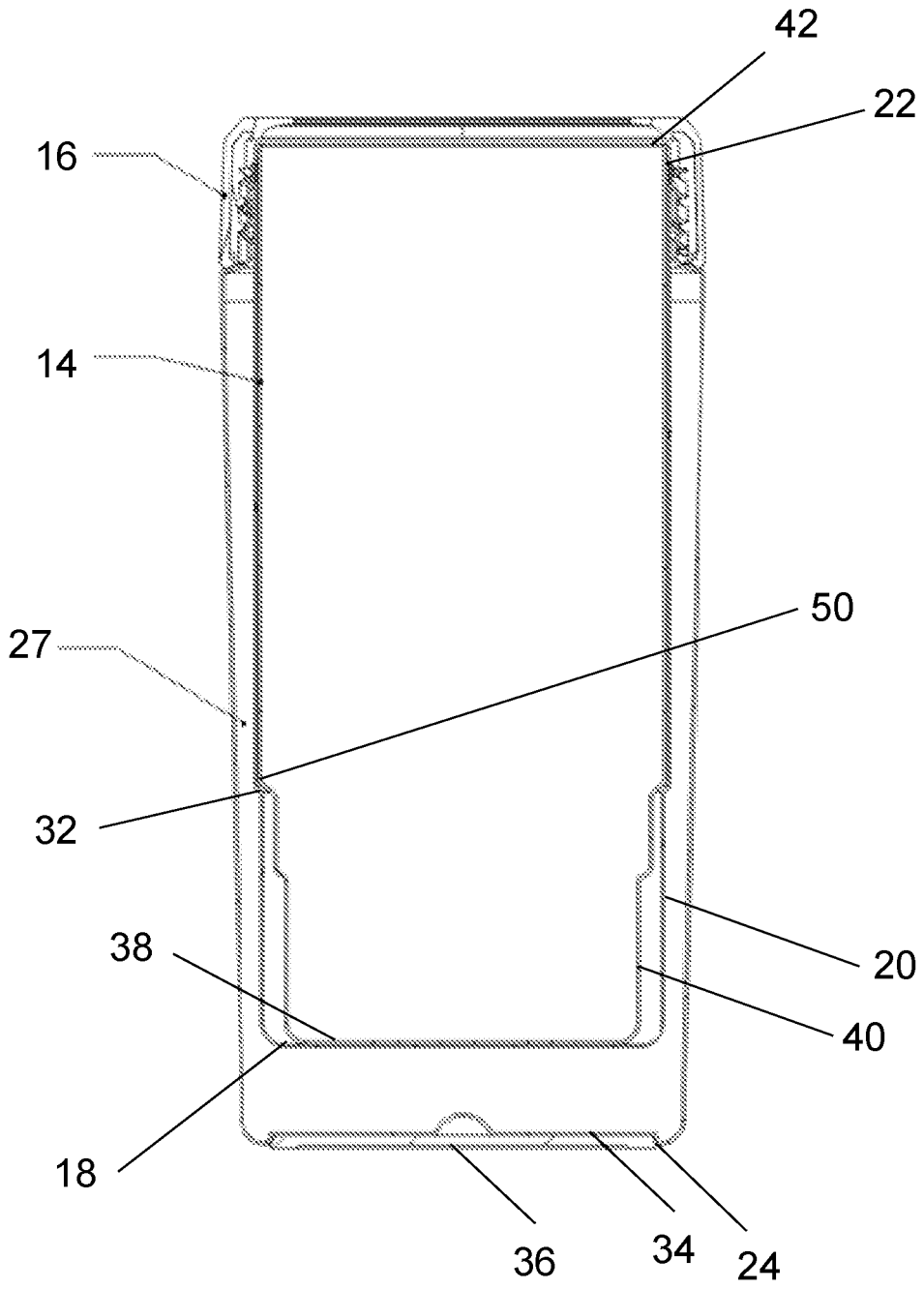
FIG. 2 is a side cross-sectional view of the first embodiment.
Figure 3:
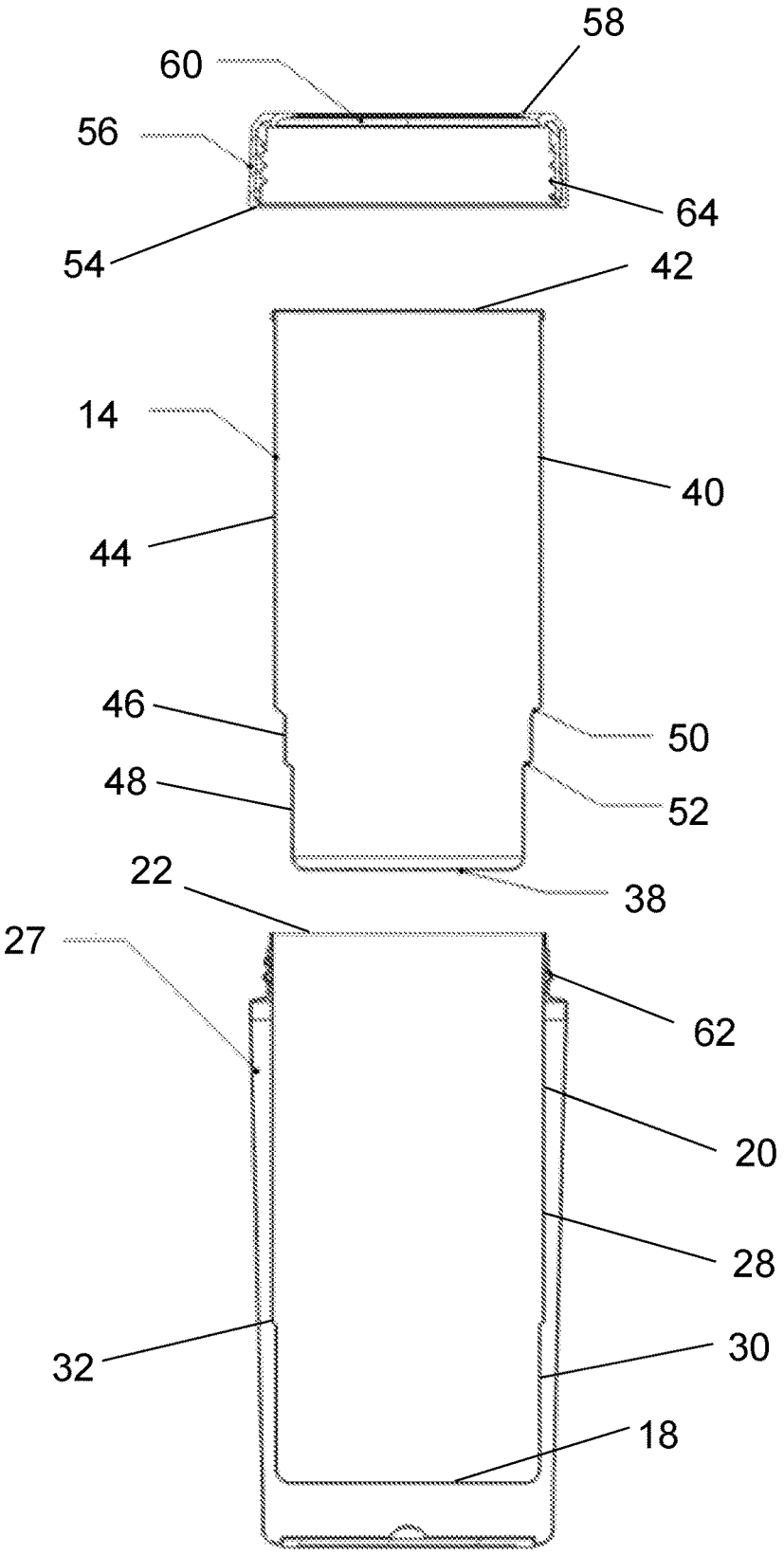
FIG. 3 is an exploded side cross-sectional view the first embodiment.
Figure 4:
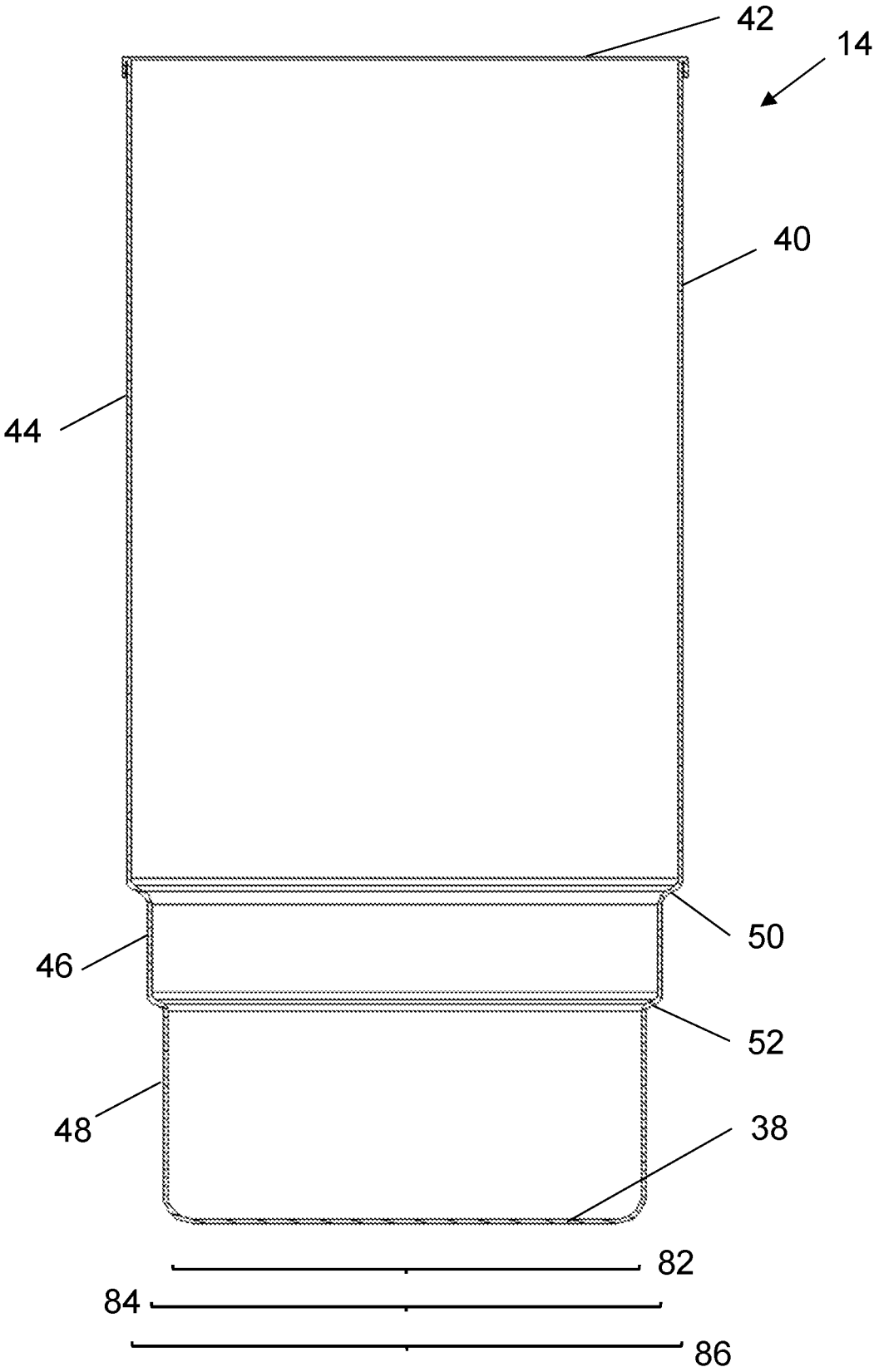
FIG. 4 is a side cross-sectional view of the inner container of the first embodiment.

For the purposes of promoting an understanding of the principles of the invention, reference will now be made to selected embodiments illustrated in the drawings and specific language will be used to describe the same. It will nevertheless be understood that no limitation of the scope of the invention is thereby intended; any alterations and further modifications of the described or illustrated embodiments, and any further applications of the principles of the invention as illustrated herein are contemplated as would normally occur to one skilled in the art to which the invention relates. At least one embodiment of the invention is shown in great detail, although it will be apparent to those skilled in the relevant art that some features or some combinations of features may not be shown for the sake of clarity.

Any reference to "invention" within this document is a reference to an embodiment of a family of inventions, with no single embodiment including features that are necessarily included in all embodiments, unless otherwise stated. Furthermore, although there may be references to "advantages" provided by some embodiments of the present invention, other embodiments may not include those same advantages, or may include different advantages. Any advantages described herein are not to be construed as limiting to any of the claims.

Specific quantities (spatial dimensions, dimensionless parameters, etc.) may be used explicitly or implicitly herein, such specific quantities are presented as examples only and are approximate values unless otherwise indicated. Any quantities referred to as "about" a given value are defined as being within 5% of the stated value unless otherwise specified (e.g., "about 1.0 mm" refers to the range of 0.95 mm to 1.05 mm; "between about 1.0 mm and 2.0 mm" refers to the range of 0.95 mm to 2.1 mm). Discussions pertaining to specific compositions of matter, if present, are presented as examples only and do not limit the applicability of other compositions of matter, especially other compositions of matter with similar properties, unless otherwise indicated. The terms top and bottom, upper and lower, and similar language used herein refer to the orientation of the insulating beverage container as shown in the drawings.

Referring to FIGS. 1A-9, a first embodiment of an insulating beverage container 10 includes an outer container 12, an inner container 14, and a cover 16.

The outer container 12 includes an interior bottom 18, an inner wall 20 extending peripherally around the interior bottom 18 and terminating in an open upper end 22, and an exterior bottom 24 spaced from the interior bottom 18, an outer wall 26 extending peripherally around the exterior bottom 24 and spaced from the inner wall 20 to define an insulating space 27 between the inner wall 20 and outer wall 26 and terminating at the open upper end 22. The inner wall 20 includes an upper portion 28 and a lower portion 30, wherein the upper portion 28 and the lower portion 30 each have a consistent diameter, the consistent diameter of the lower portion 30 being smaller than the consistent diameter of the upper portion 28. The inner wall 20 includes an annular inner wall ledge 32 formed between the upper portion 28 of the inner wall 20 and lower portion 30 of the inner wall 20.

The exterior bottom 24 may include an elevated (as viewed from beneath) or concave surface 34. In the depicted embodiment, a resilient non-slip base 36 is positioned at least partially within the concave surface 34. In some embodiments, the resilient base 36 is a thin rubber disc.

The outer container 12 has a generally cylindrical shape, slightly tapering from the upper end 22 to the exterior bottom 24, and may be rotationally symmetrical. In other embodiments (not shown), the outer container 12 may not be symmetrical and may include a handle or other feature for grasping the outer container 12.

The inner container 14 includes a perforated bottom 38 and a side 40 extending peripherally around the perforated bottom 38 and terminating in an open top end 42. The inner container 14 is configured to removably nest within the outer container 12 through the open upper end 22. When nested, the top end 42 extends above the upper end 22, such that the inner container 14 may be easily grasped and retrieved from within the outer container 12.

The side 40 of the inner container 14 includes an upper portion 44, an intermediate portion 46, and a lower portion 48, wherein the lower portion 48 of the side 40 has a consistent diameter that is smaller than the consistent diameter of the intermediate portion 46 of the side 40, and wherein the intermediate portion 46 of the side 40 has a consistent diameter that is smaller than the consistent diameter of the upper portion 48 of the side 40. An annular first side ledge 50 is formed between the upper portion 44 and the intermediate portion 46, and an annular second side ledge 52 is formed between the intermediate portion 46 and the lower portion 48. When the inner container 14 is nested within the outer container 12, the inner wall ledge 32 engages and supports one of the annular side ledges 50, 52. In the depicted embodiment, the inner wall ledge 32 engages and supports the first side ledge 50.

The cover includes a circular base 54 and a cylindrical sidewall 56 extending generally upwards from the circular base 54 to a top surface 58. The top surface 58 includes an aperture 60 having a diameter smaller than the top end 42 of the inner container 14 to mechanically retain the inner container 14 within the outer container 12, while allowing the top of a beverage bottle or beverage can to extend through the aperture 60, as shown in FIGS. 6-9. A user may then drink from the beverage bottle or beverage can while the majority of the bottle or can remains insulated within the insulating beverage container 10.

The cover 16 is configured to removably attach and detach from the outer container 12 via threading, snap fit, interference fit, or other type of engagement as generally known in the art. In the depicted first embodiment, the outer wall 26 includes threading 62 adjacent the upper end 22 and the sidewall 56 of the cover 16 includes an interior surface 64 with corresponding threading configured to engage the threading 62 on the outer wall 26. When in an assembled configuration, as most easily seen in FIGS. 1B and FIG. 2, the cover 16 fits over and around the upper end 22 of the outer container 12 to enclose the inner container 14. The inner container 14 is securely retained by the top end 42 against the cover 16, by the perforated bottom 38 against the interior bottom 18, and by an annular side ledge 50, 52 against the inner wall ledge 32.

Figure 10:
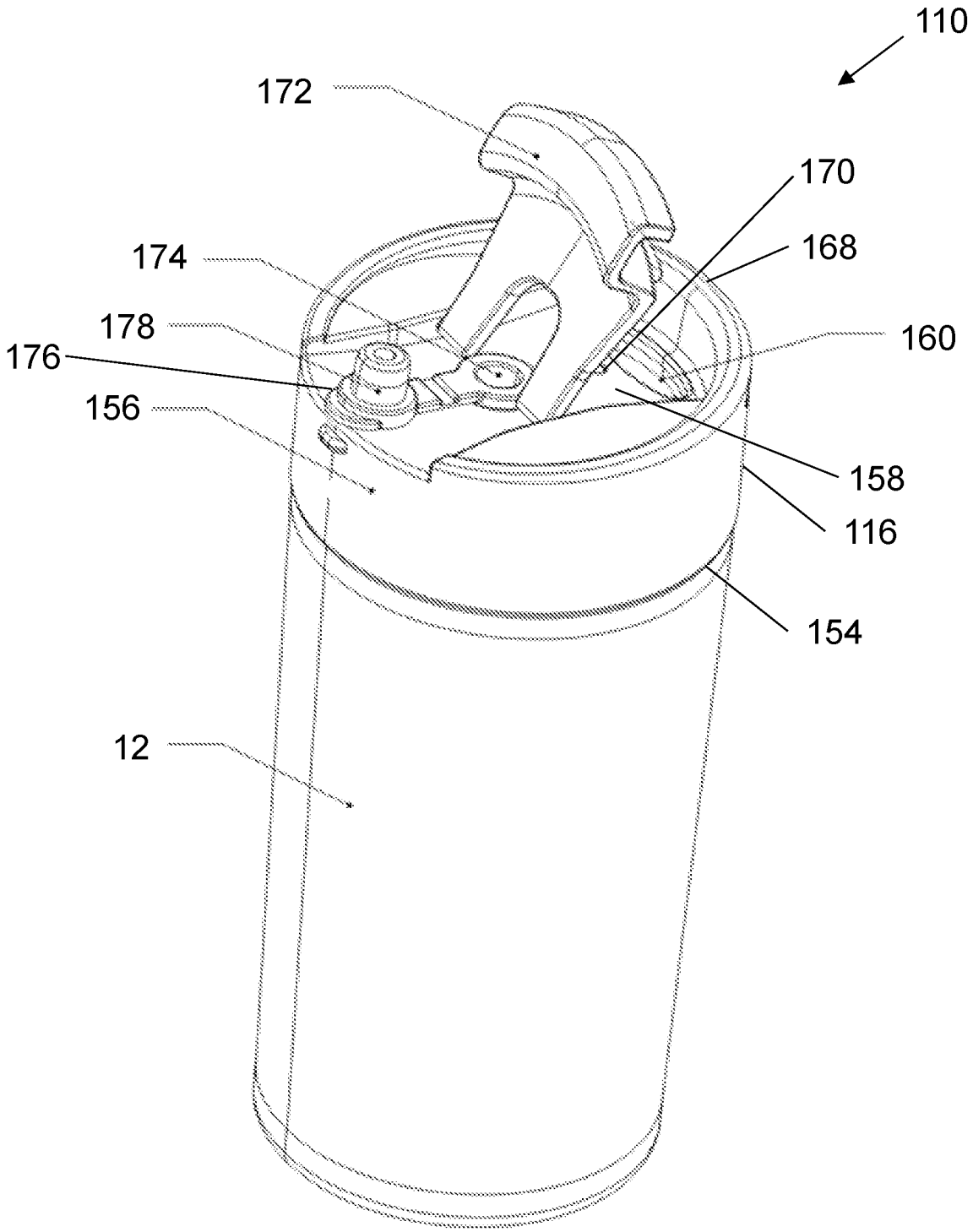
FIG. 10 is a side perspective view of a second embodiment of an insulating beverage container.
Figure 11:
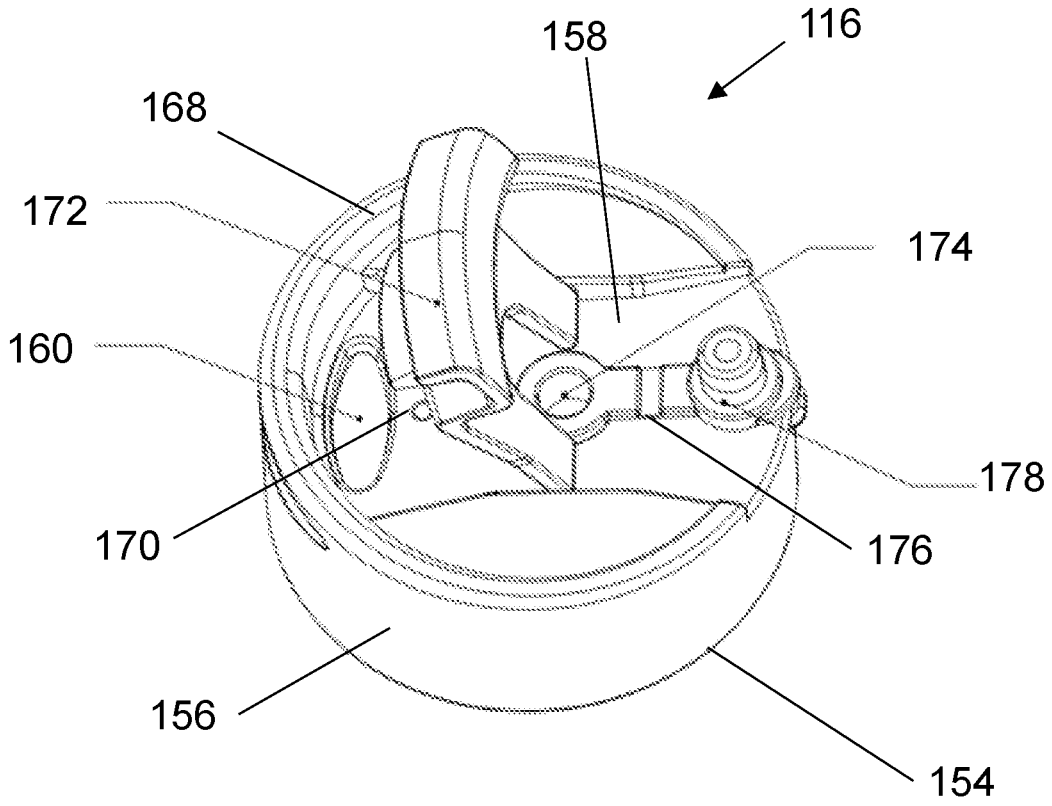
FIG. 11 is a top perspective view of the cover of the second embodiment.
Figure 12:
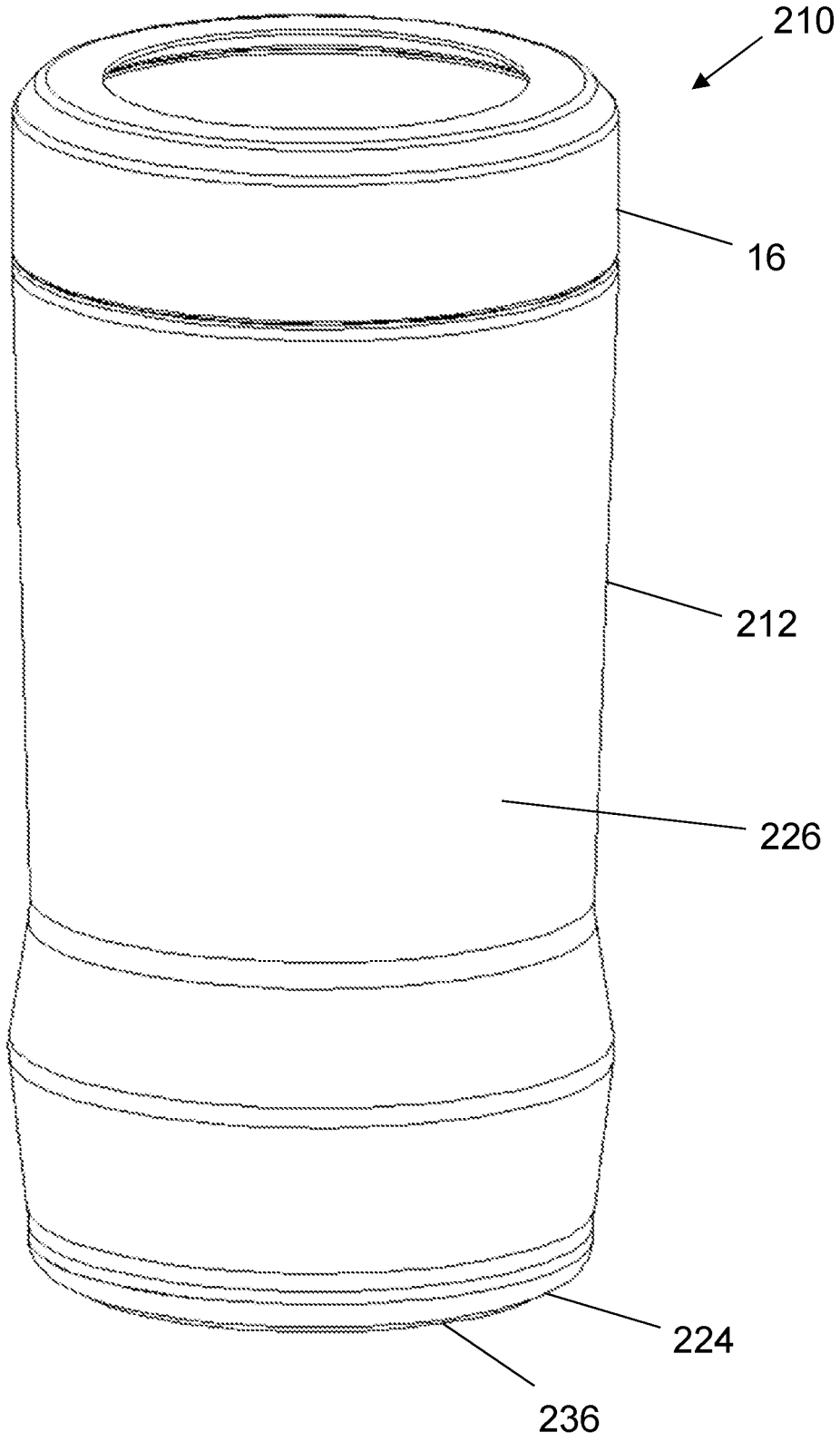
FIG. 12 is a side perspective view of a third embodiment of an insulating beverage container.
Figure 13:
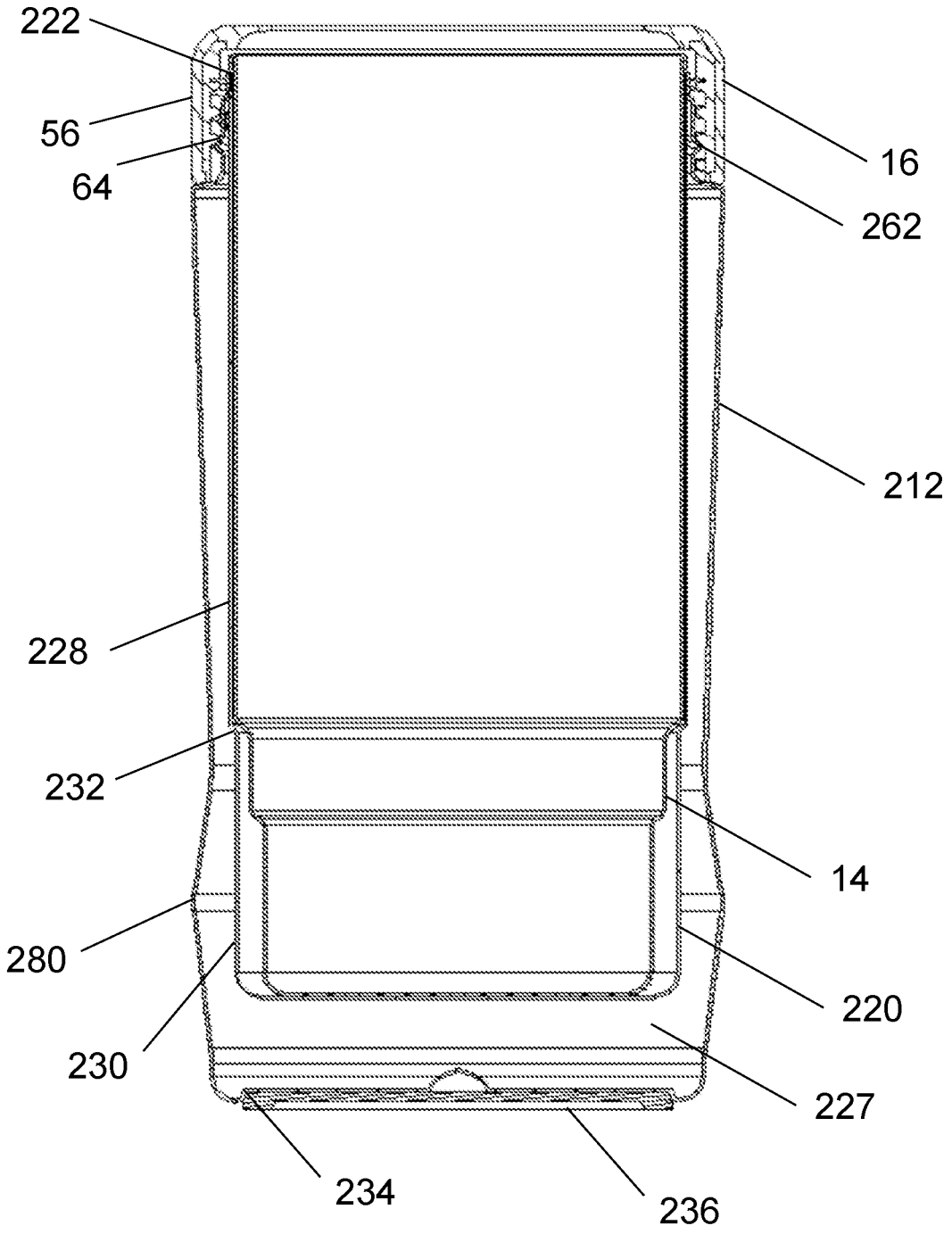
FIG. 13 is a side cross-sectional view of the third embodiment.

Referring now to FIGS. 10 and 11, a second embodiment of an insulating beverage container 110 includes the same outer container 12 and inner container 14 as the first embodiment, but incorporates a different cover 116. The cover 116 includes a circular base 154 and a cylindrical sidewall 156 extending generally upwards from the circular base 154 to a top surface 158. The top surface 158 includes a raised rim 168 that extends partially around the perimeter of the top surface 158. The top surface 158 includes a first aperture 160, a vent hole 170, and a hinged closure 172 arranged to transition between a closed configuration and an open configuration. When in the closed configuration, the hinged closure 172 seals the first aperture 160 and the vent hole 170 and mechanically engages the raised rim 168 via a snap fit. The top surface 158 further includes a second aperture 174 and a flexible closure 176. The flexible closure 176 is arranged to transition between a closed configuration and an open configuration. When in the closed configuration, a plug portion 178 of the flexible closure 176 is inserted at least partially into the second aperture 174 to seal the second aperture 174. The hinged closure and flexible closure are shown in an open configuration in FIGS. 10 and 11. The cover 116 in the second embodiment of the insulating beverage container 110 is configured to removably attach and detach from the outer container 12 in a similar manner as the cover 16 in the first embodiment of the insulating beverage container 10.

In use, a user may add a beverage directly into the outer container 12, attach the cover 116, then transition one of the hinged closure 172 and the flexible closure 176 into the open configuration to access the first aperture 160 or second aperture 174, and drink the beverage directly from the insulating beverage container 110 through the respective aperture 160, 174 (instead of inserting a bottle or can into the beverage container). The inner container 14 may be present within the outer container 12 or may be removed when drinking from the insulating beverage container 110 in this manner.

Referring to FIGS. 12-18, a third embodiment of an insulating beverage container 210 includes the same inner container 14 and cover 16 as used in the first embodiment, but incorporates a different outer container 212.

The outer container 212 includes an interior bottom 218, an inner wall 220 extending peripherally around the interior bottom 218 and terminating in an open upper end 222, and an exterior bottom 224 spaced from the interior bottom 218, an outer wall 226 extending peripherally around the exterior bottom 224 and spaced from the inner wall 220 to define an insulating space 227 between the inner wall 220 and outer wall 226 and terminating at the open upper end 222. The inner wall 220 includes an upper portion 228 and a lower portion 230, wherein the upper portion 228 and the lower portion 230 each have a consistent diameter, the consistent diameter of the lower portion 230 being smaller than the consistent diameter of the upper portion 228. The inner wall 220 includes an annular inner wall ledge 232 formed between the upper portion 228 of the inner wall 220 and lower portion 230 of the inner wall 220. The exterior bottom 224 may include an elevated (as viewed from beneath) or concave surface 234. In the depicted embodiment, a resilient non-slip base 236, such as a thin rubber disc, is positioned at least partially within the concave surface 234. The outer container 12 has a generally cylindrical shape, slightly tapering from the upper end 222 to the exterior bottom 224, and may be rotationally symmetrical. In other embodiments (not shown), the outer container 212 may not be symmetrical and may include a handle or other feature for grasping the outer container 212. The cover 16 is configured to removably attach and detach from the outer container 212 via threading, snap fit, interference fit, or other type of engagement as generally known in the art. In the depicted third embodiment, the outer wall 226 includes threading 262 adjacent the upper end 222 and the sidewall 56 of the cover 16 includes an interior surface 64 with corresponding threading configured to engage the threading 262 on the outer wall 226.

While the outer wall 26 in the first embodiment gradually tapers from the upper end 22 to the exterior bottom 24, the outer wall 226 in the third embodiment gradually tapers downward from the upper end 222, then radially expands with a convex portion 280. In some embodiments, as most easily seen in FIG. 13, the convex portion 280 extends between the exterior bottom 224 and the elevation of the annular inner wall ledge 232. A user may grasp the insulating beverage container 210 at a position slightly above the convex portion 280, such that the increasing diameter of the outer wall 226 above the user's hand (due to the taper) and below the user's hand (due to the convex portion 280) reduces the possibility that the user's hand will slip upwards or downwards.

Figure 6:
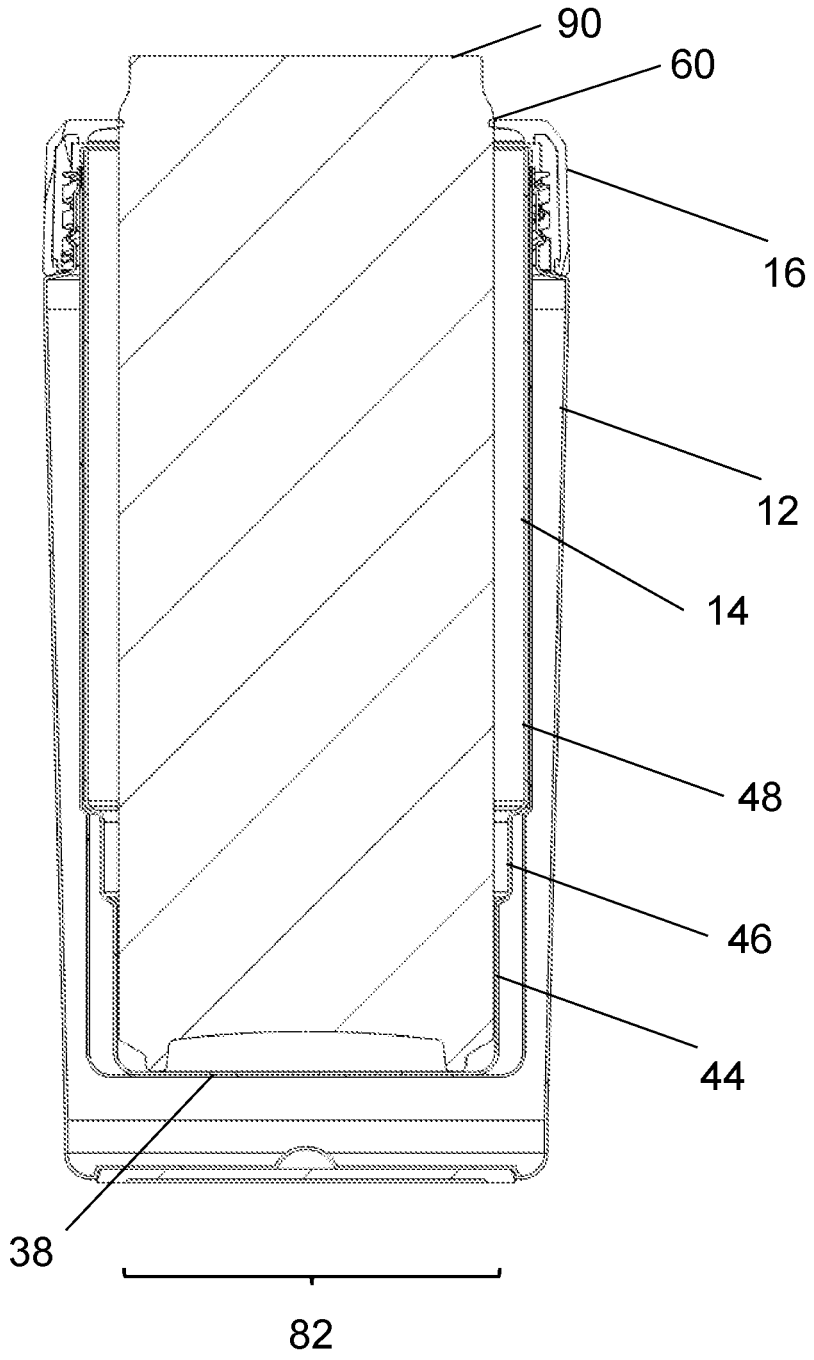
FIG. 6 is a side cross-sectional view of the first embodiment holding a tall slim 12 oz. beverage can.
Figure 7:
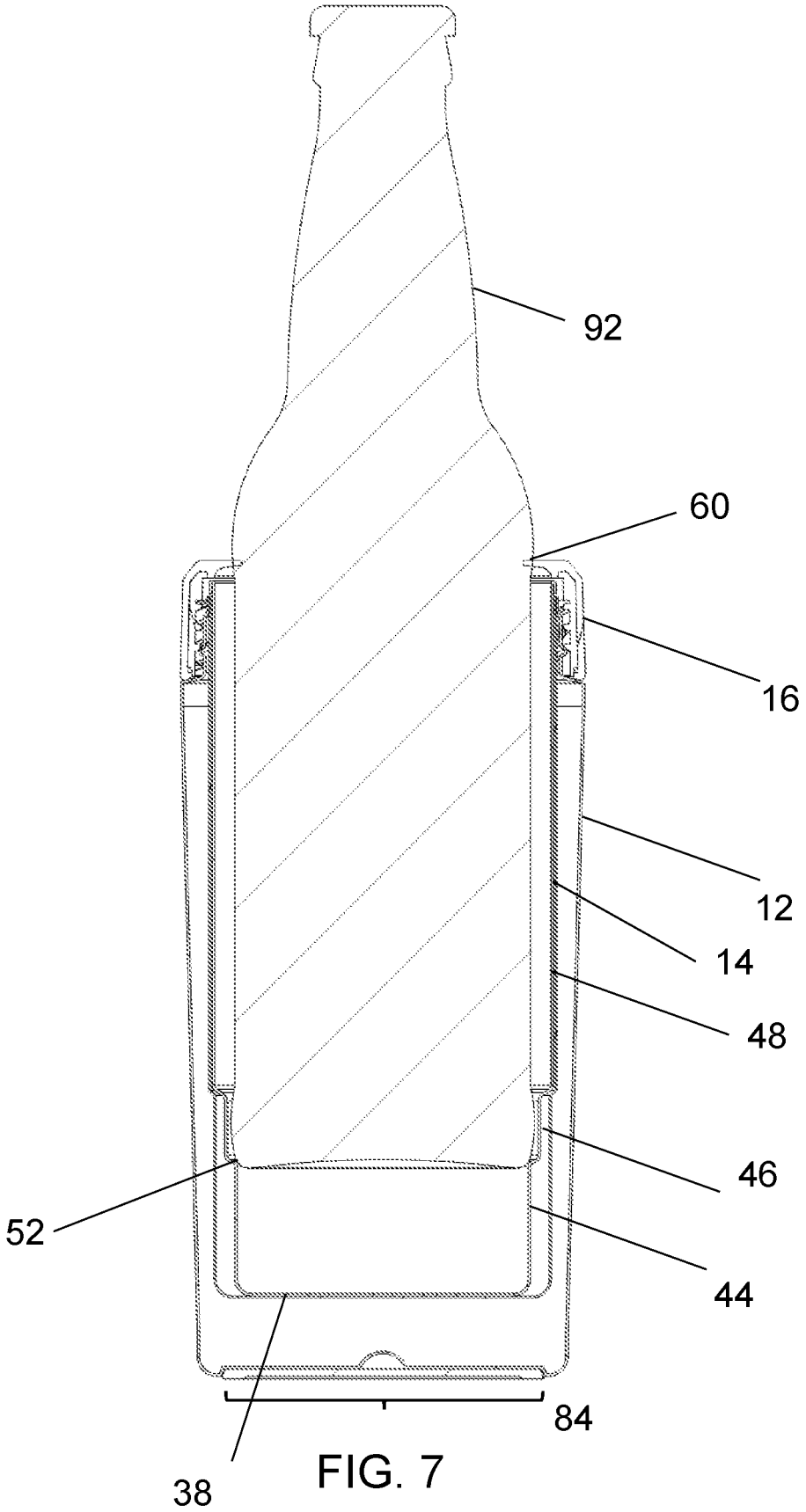
FIG. 7 is a side cross-sectional view of the first embodiment holding a 12 oz. longneck beverage bottle.
Figure 8:
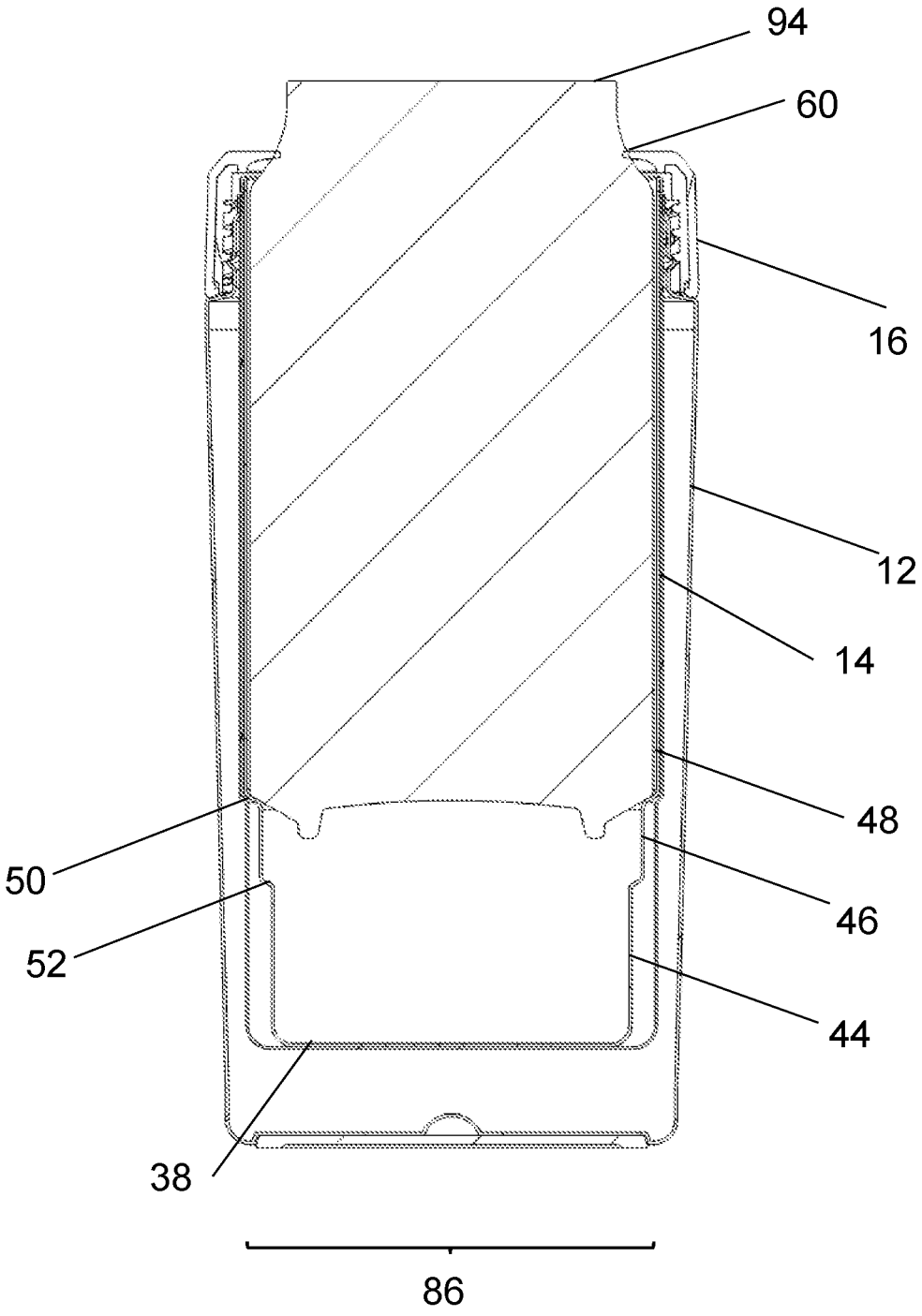
FIG. 8 is a side cross-sectional view of the first embodiment holding a standard 12 oz. beverage can.
Figure 9:
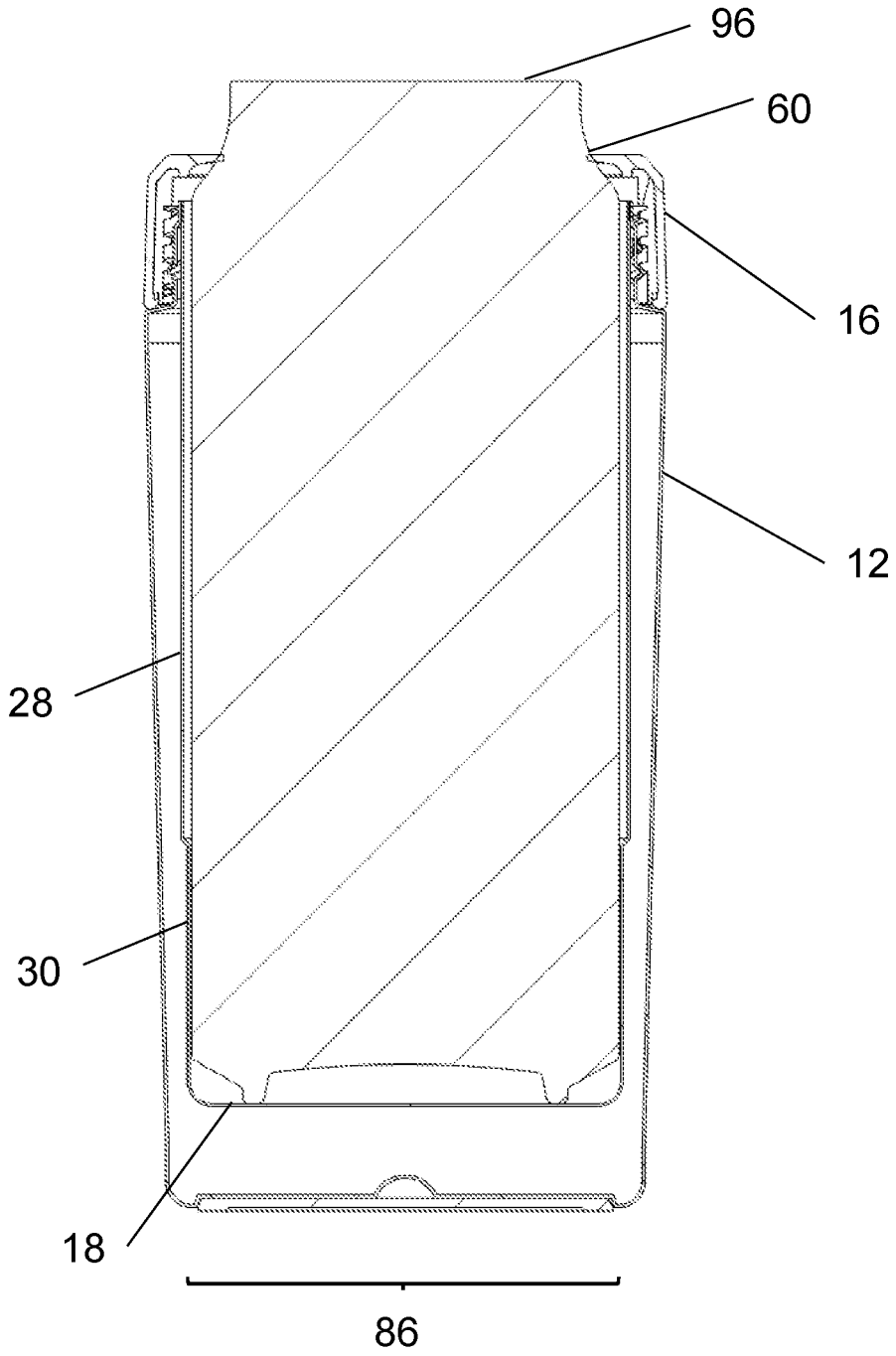
FIG. 9 is a side cross-sectional view of the first embodiment with the inner container removed and holding a 16 oz. beverage can.
Figure 14:
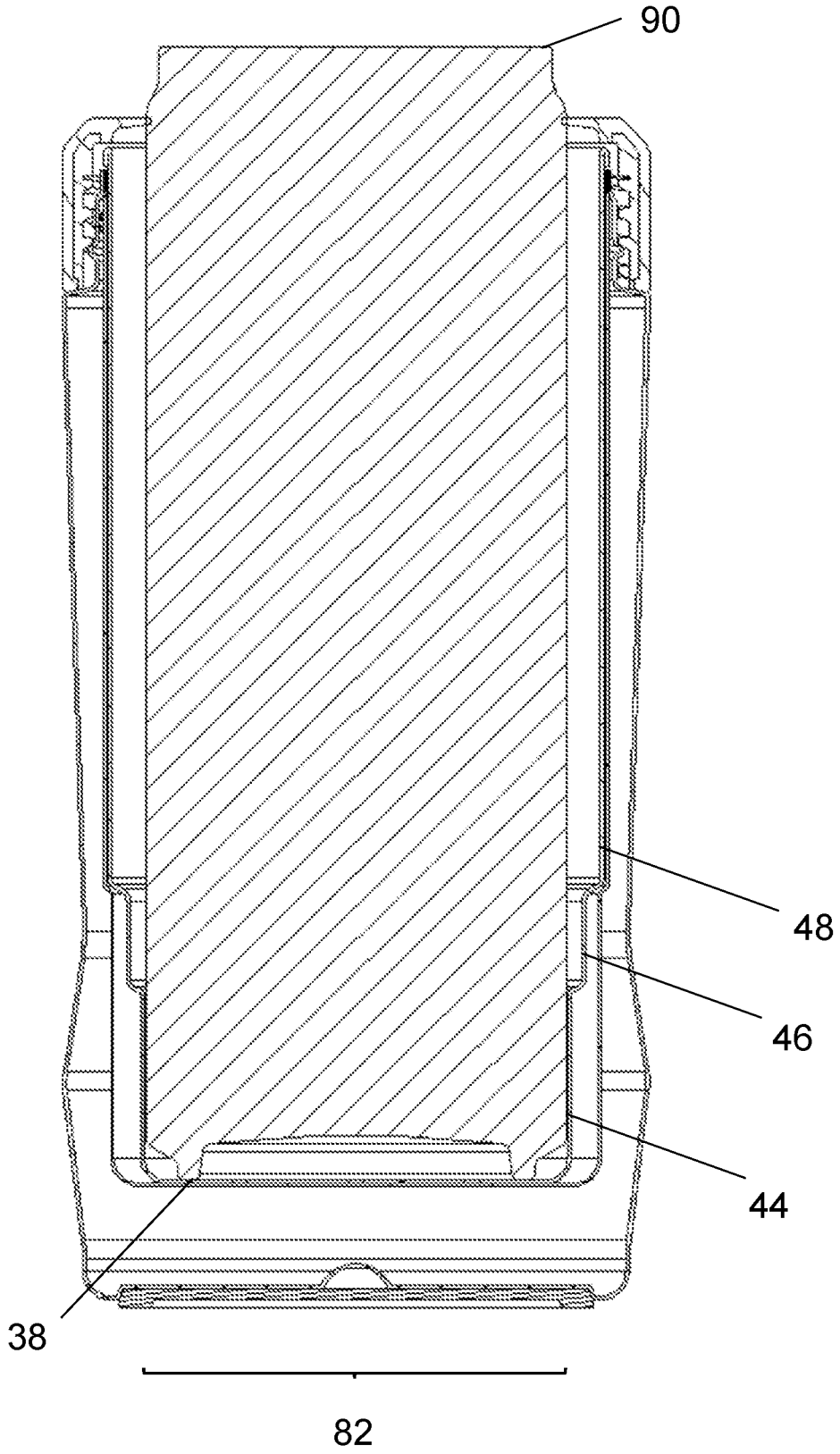
FIG. 14 is a side cross-sectional view of the third embodiment holding a a tall slim 12 oz. beverage can.
Figure 15:
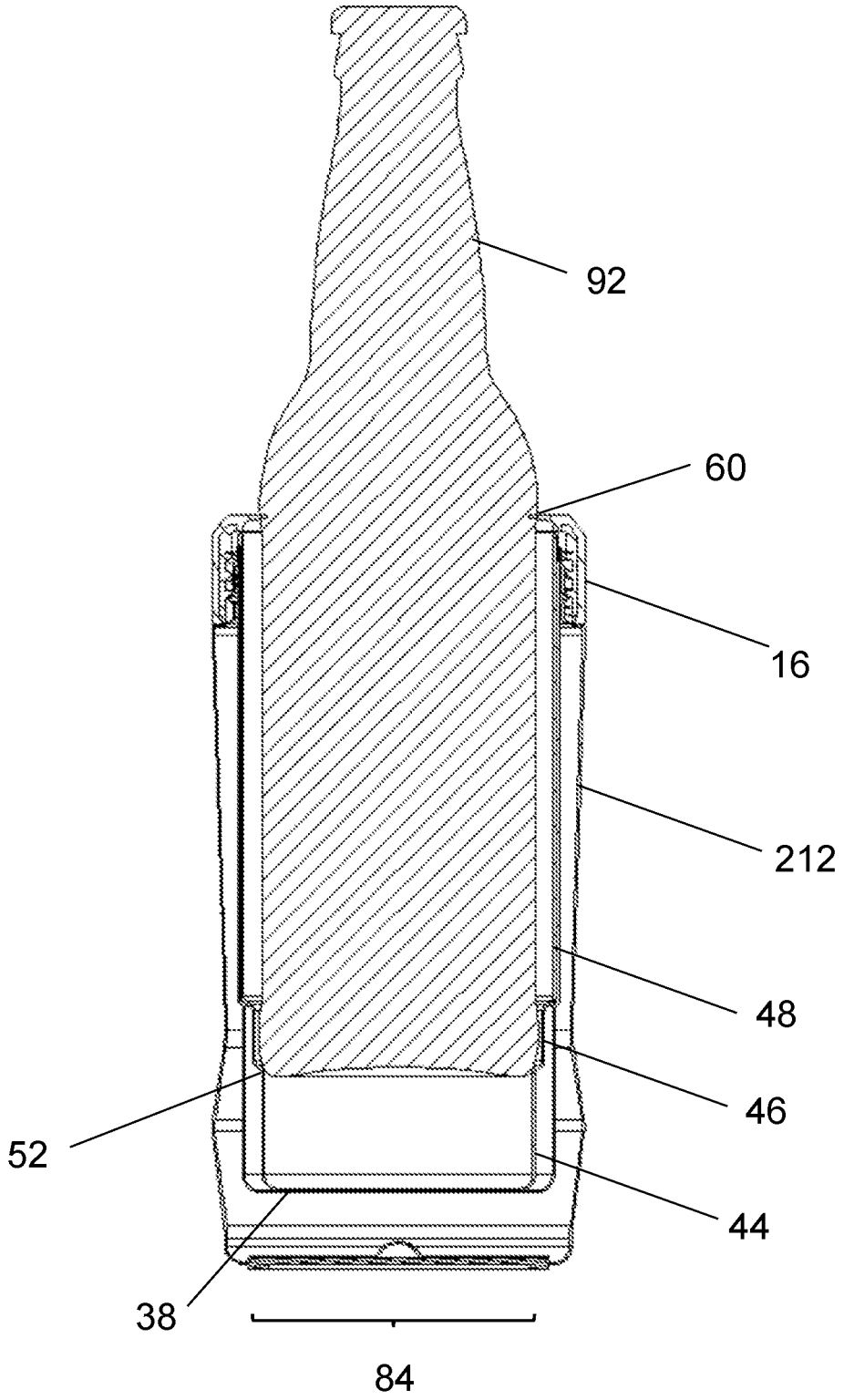
FIG. 15 is a side cross-sectional view of the third embodiment holding a 12 oz. longneck beverage bottle.
Figure 16:
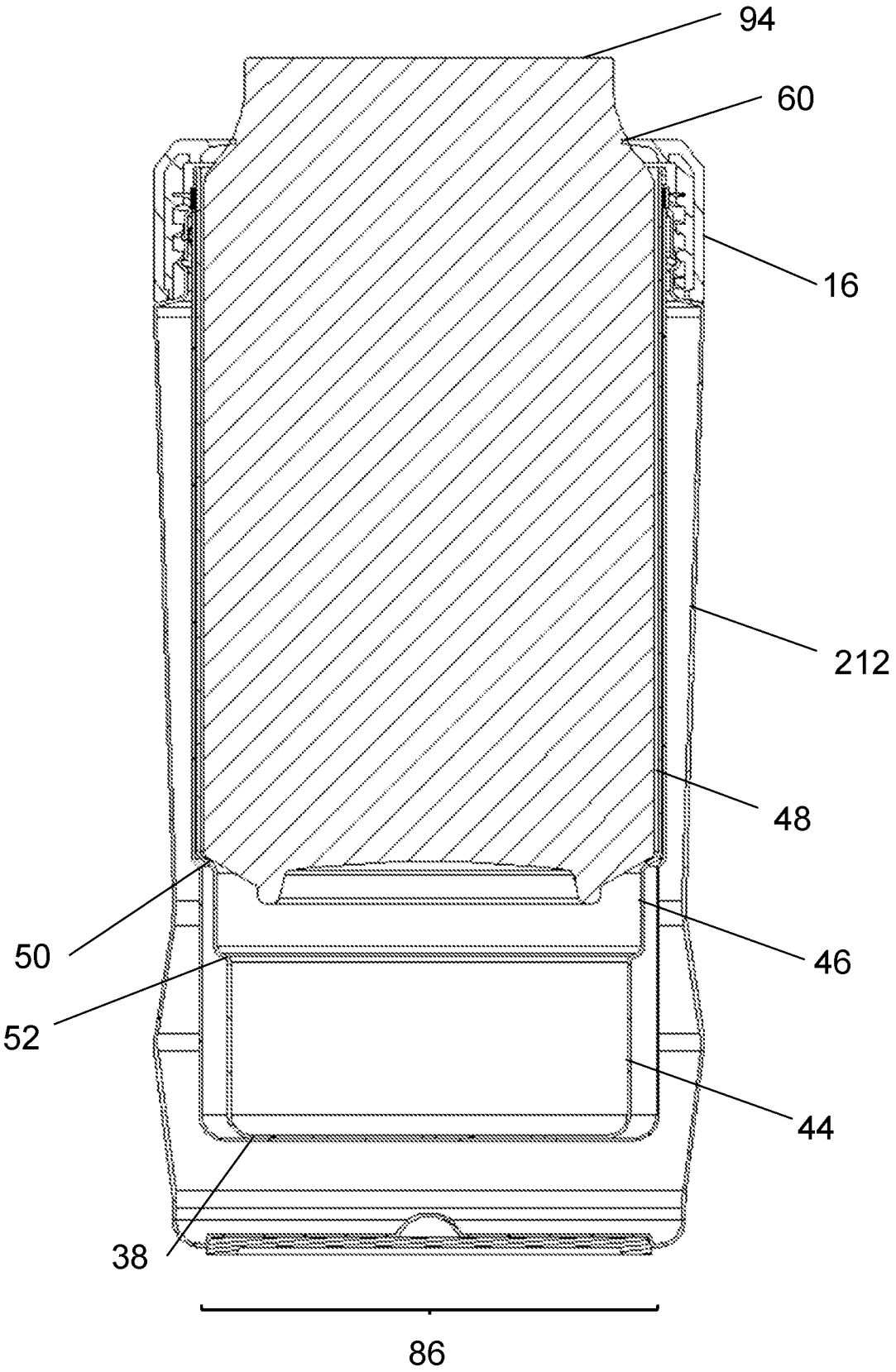
FIG. 16 is a side cross-sectional view of the third embodiment holding a standard 12 oz. beverage can.
Figure 17:
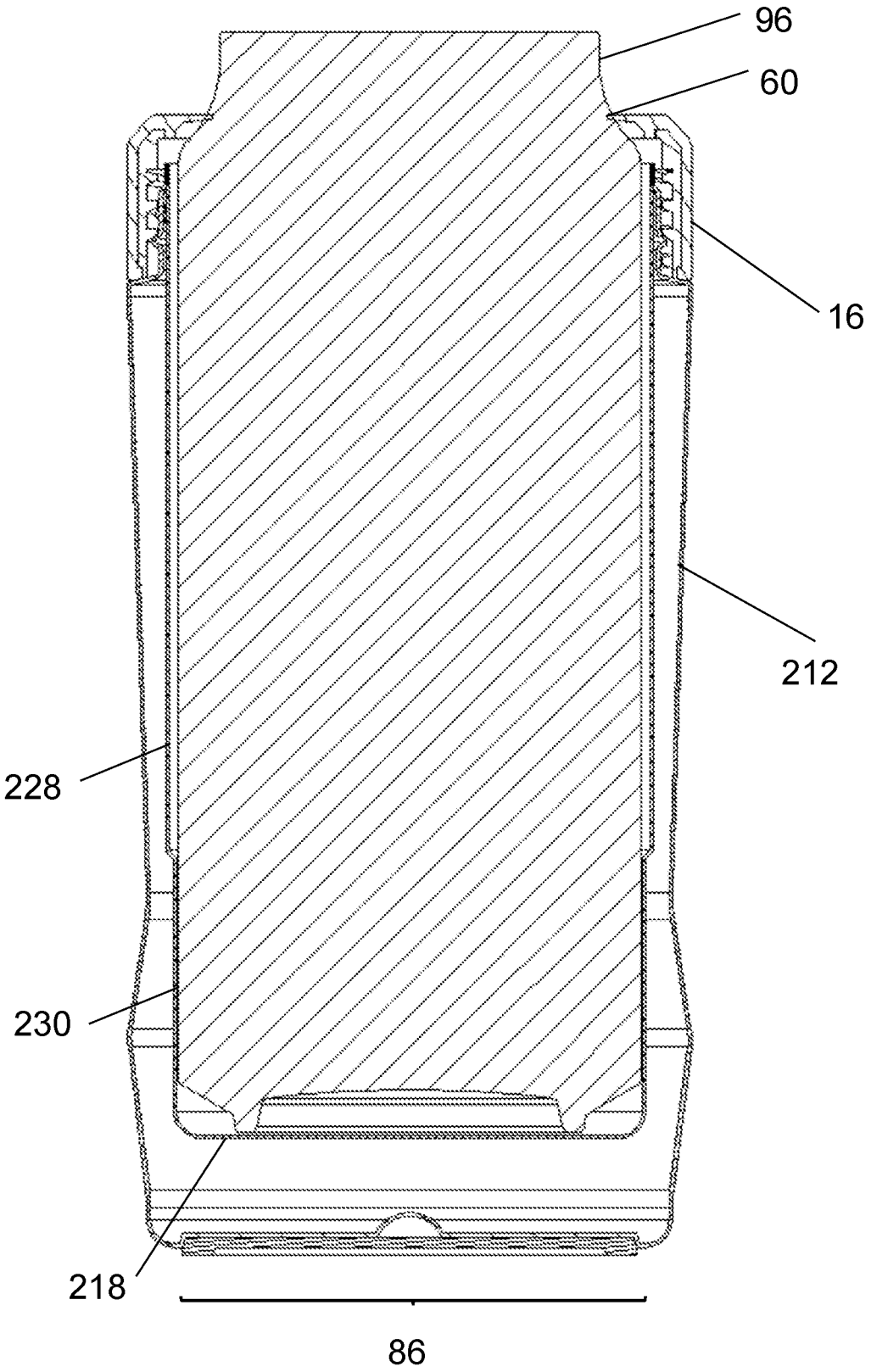
FIG. 17 is a side cross-sectional view of the third with the inner container removed and holding a 16 oz. beverage can.
Figure 18:
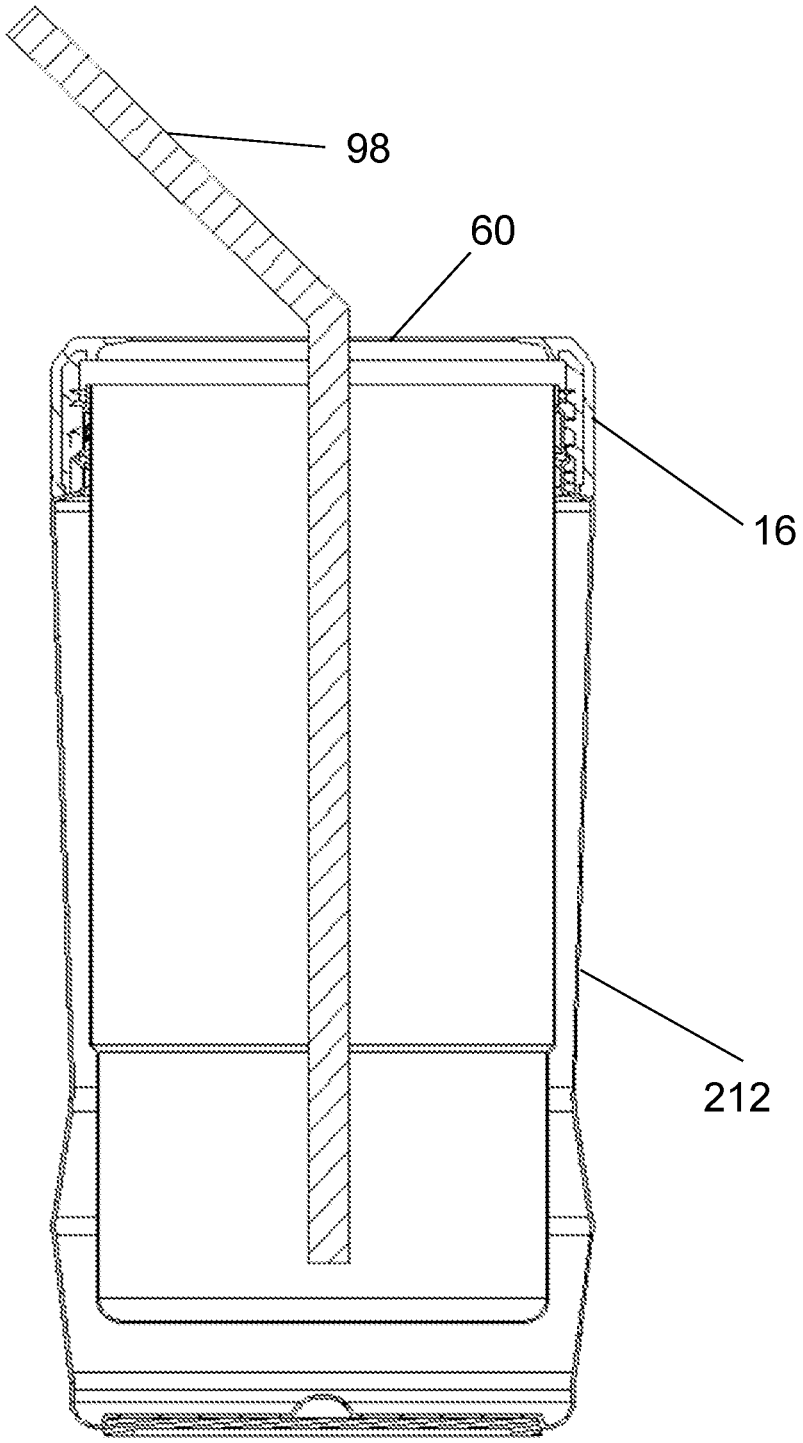
FIG. 18 is a side cross-sectional of the third embodiment with the inner container removed and holding a straw.

The insulating beverage container 10, 210 is configured to accommodate and securely retain beverage cans or bottles of multiple different sizes while allowing the top of the can or bottle to extend through the aperture 60, as well as serving as a container for beverages itself. While the inner container 14 is nested within the outer container 12, 212, the insulating beverage container 10, 210 may snugly receive and support beverage bottles or cans of at least three different diameters: (1) a first and smallest diameter 82, wherein the beverage bottle or beverage can will rest upon the perforated bottom 38 and snugly fit within the lower portion 46 as shown in FIGS. 6 and 14 (e.g. a tall slim 12 oz. beverage can 90 or many 8 oz., 12 oz., or 16.9 oz. bottled water bottles with a diameter of about 2.25 inches); (2) a second diameter 84 larger than the first diameter 82, wherein the beverage bottle or beverage can will rest upon the second side ledge 52 and snugly fit within the intermediate portion 46 as shown in FIGS. 7 and 15 (e.g., a standard 12 oz. long neck beverage bottle 92 with a diameter of about 2.5 inches); and (3) a third diameter 86, larger than the second diameter 84, wherein the beverage bottle or beverage can will rest upon the first side ledge 50 and snugly fit within the upper portion 44 as shown in FIGS. 8 and 16 (e.g., a standard 12 oz. beverage can 94 with a diameter of about 2.6 inches). The inner container 14 may be removed from the outer container 12 and a beverage bottle or can may be inserted to rest upon the interior bottom 18 and snugly fit within the lower portion 30 as shown in FIGS. 9 and 17 (e.g., a 16 oz. beverage can 96, a 16.9 oz soda bottle, or a 16 oz. bottle with a diameter of about 2.6 inches). Furthermore, the outer container 10, 110, 210 may be used as a beverage container itself, as shown in FIG. 10, wherein the cover 116 provides controlled access to a beverage within the outer container 12, and as shown in FIG. 18, where a straw 98 is inserted through the aperture 60 for a user to drink a beverage directly from the outer container 212.

In further embodiments (not shown), the side of the inner container may include additional intermediate portions of consistent diameters not identical to the diameters of the upper, intermediate, or lower portions, and additional corresponding annular side ledges such that the inner container is configured to accommodate a fourth, fifth, or greater number of diameters of beverage bottles or beverage cans.

In the depicted embodiment, the interior bottom 18, 218 and first side ledge 50 are both sized to accommodate beverage bottles or cans of approximately equal diameter. A user would determine whether to include the inner container 14 to rest the beverage bottle or beverage can on the first side ledge 50 or to remove the inner container 14 to rest the bottle or can on the interior bottom 18, 218 based on the height of the bottle or can, such that the top of the bottle or can extends through the aperture 60 of the cover 16 and remains accessible to the user.

Figure 5:
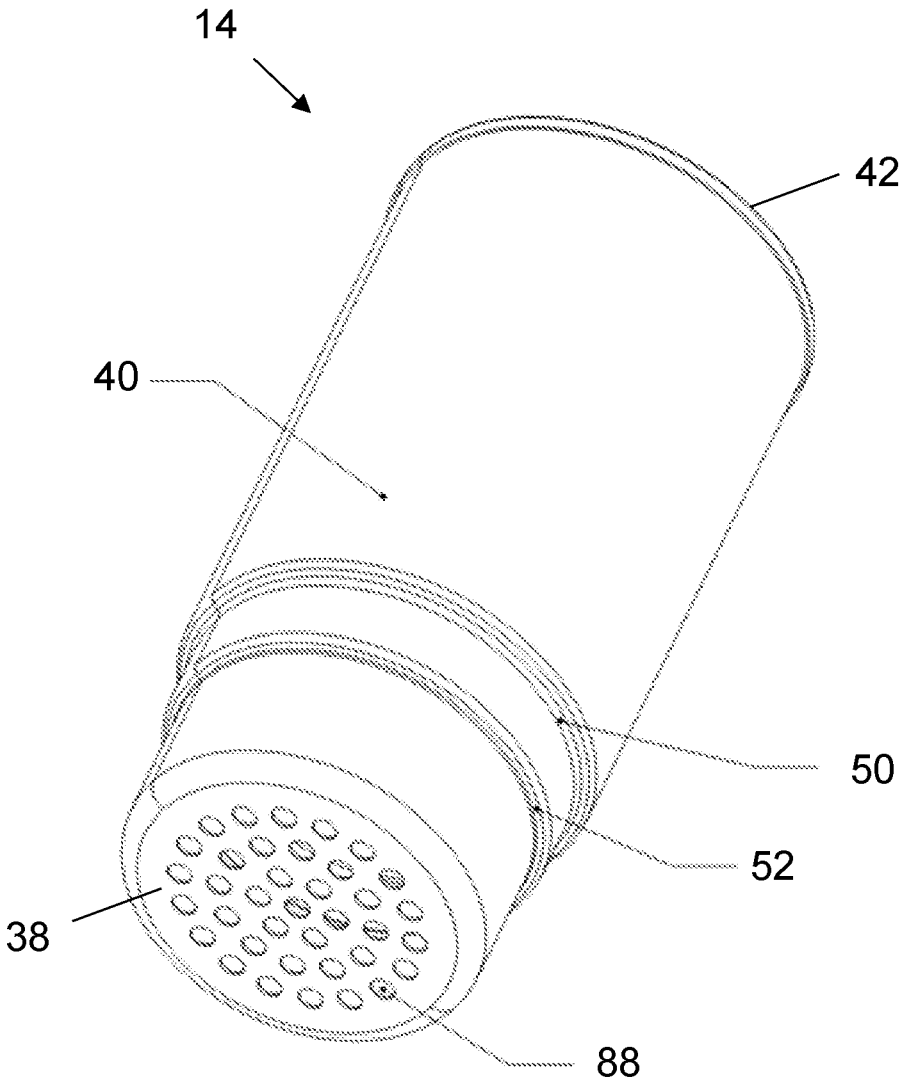
FIG. 5 is a bottom perspective view of the inner container of the first embodiment.

As most easily seen in FIG. 5, the inner container 14 includes a perforated bottom 38. Passage of air through the perforations 88 prevents the formation of a vacuum between the inner container 14 and outer container 12, 212, facilitating the insertion and removal of the inner container 14 from the outer container 12, 212. In addition, the perforated bottom 38 allows the insulating beverage container 10, 110, 210 to be used for filtering tea, coffee, or other liquids. A user may place a tea bag or coffee bag within the inner container 14 such that the bag covers substantially all of the perforated bottom 38. The user would then hold the inner container 14 above the outer container 12, 212 and pour hot water into the inner container 14, such that the water passes through the bag then through the perforations 38 to drip into the outer container 12, 212. Accordingly, the present invention is useful in making tea, coffee, or other filtered beverages while hiking, camping, or otherwise remote from traditional tea filters and similar apparatuses.

Various aspects of different embodiments of the present disclosure are expressed in paragraphs X1 and X2 as follows:

X1. One embodiment of the present disclosure includes an insulating beverage container having an outer container having, an interior bottom, an inner wall extending peripherally around the interior bottom and terminating in an open upper end, an exterior bottom spaced from the interior bottom, and an outer wall extending peripherally around the exterior bottom and spaced from the inner wall to define an insulating space between the inner wall and outer wall and terminating at the open upper end; an inner container removably nested within the outer container through the open upper end, the inner container having a bottom and a side extending peripherally around the bottom and terminating in an open top end; and a cover removably attached to the upper end; wherein the side includes an upper portion, an intermediate portion, and a lower portion, wherein the lower portion of the side has a smaller diameter than the intermediate portion of the side, and wherein the intermediate portion of the side has a smaller diameter than the upper portion of the side; and wherein the side includes an annular first side ledge formed between the upper portion of the side and the intermediate portion of the side, and an annular second side ledge formed between the intermediate portion of the side and the lower portion of the side.

X2. Another embodiment of the present disclosure includes an insulating beverage container having an outer container having an interior bottom, an inner wall extending peripherally around the interior bottom and terminating in an open upper end, an exterior bottom spaced from the interior bottom, and an outer wall extending peripherally around the exterior bottom and spaced from the inner wall to define an insulating space between the inner wall and outer wall and terminating at the open upper end; an inner container removably nested within the outer container through the open upper end, the inner container having a bottom and a side extending peripherally around the bottom and terminating in an open top end; and wherein the side includes an upper portion, an intermediate portion, and a lower portion, wherein the lower portion of the side has a smaller diameter than the intermediate portion of the side, and wherein the intermediate portion of the side has a smaller diameter than the upper portion of the side; wherein the side includes an annular first side ledge formed between the upper portion of the side and the intermediate portion of the side, and an annular second side ledge formed between the intermediate portion of the side and the lower portion of the side; and wherein one of the first side ledge and the second side ledge is supported by the inner wall ledge.

Yet other embodiments include the features described in any of the previous paragraphs X1 or X2, as combined with one of more of the following aspects:

Wherein the inner wall includes an upper portion and a lower portion, wherein the lower portion of the inner wall has a smaller diameter than the upper portion of the inner wall, and wherein the inner wall includes an annular inner wall ledge formed between the upper portion of the inner wall and lower portion of the inner wall.

Wherein the inner wall ledge engages one of the first side ledge and the second side ledge.

Wherein one of the first side ledge and the second side ledge is supported by the inner wall ledge.

Wherein the cover fits over and around the upper end of the outer container to enclose the inner container.

Wherein the inner container is securely retained by the top end against the cover, by the perforated bottom against the interior bottom, and by one of the first annular side ledge and the second annular side ledge against the inner wall ledge.

Wherein the side extends above the upper end.

Wherein the cover includes a circular base and cylindrical sidewall extending generally upwards from the circular base to a top surface.

Wherein the top surface includes an aperture having a diameter smaller than the upper end of the inner container.

Wherein the aperture is sized to pass at least a portion of a beverage can or beverage bottle.

Wherein the aperture is a first aperture, and wherein the top surface further includes a hinged closure arranged to transition between a closed configuration wherein the hinged closure seals the first aperture and an open configuration.

Wherein the top surface includes a raised rim that extends partially around a perimeter of the top surface.

Wherein, when in the closed configuration, the hinged closure mechanically engages the raised rim.

Further comprising a second aperture, and wherein the top surface further includes a flexible closure arranged to transition between a closed configuration wherein the flexible closure seals the second aperture and an open configuration.

Wherein the bottom of the inner container is a perforated bottom.

Wherein the perforated bottom is sized to receive and support a beverage can or beverage bottle of a first diameter, wherein the second side ledge is sized to receive and support a beverage can or beverage bottle of a second diameter, and wherein the first side ledge is sized to receive and support a beverage can or beverage bottle of a third diameter, wherein the third diameter is larger than the second diameter, and wherein the second diameter is larger than the first diameter.

Wherein the interior bottom is sized to receive and support a beverage can or beverage bottle of the third diameter when the inner container is removed from the outer container.

Wherein the first diameter is about 2.25 inches.

Wherein the second diameter is about 2.5 inches.

Wherein the third diameter is about 2.6 inches.

The foregoing detailed description is given primarily for clearness of understanding and no unnecessary limitations are to be understood therefrom, for modifications can be made by those skilled in the art upon reading this disclosure and may be made without departing from the spirit of the invention. Although specific spatial dimensions are stated herein, such specific quantities are presented as examples only. Reference systems, if used herein, refer generally to various directions (for example, top, bottom, upper, lower, forward, rearward, left, right, etc.), which are merely offered to assist the reader in understanding the various embodiments of the disclosure and are not to be interpreted as limiting. Other reference systems may be used to describe various embodiments.

What is claimed is:

1. An insulating beverage container comprising:

an outer container having an interior bottom, an inner wall extending peripherally around the interior bottom and terminating in an open upper end, the inner wall including an upper portion and a lower portion, wherein the lower portion of the inner wall has a smaller diameter than the upper portion of the inner wall, and wherein the inner wall includes an annular inner wall ledge formed between the upper portion of the inner wall and lower portion of the inner wall, an exterior bottom spaced from the interior bottom, and an outer wall extending peripherally around the exterior bottom and spaced from the inner wall to define an insulating space between the inner wall and outer wall and terminating at the open upper end;

an inner container removably nested within the outer container through the open upper end, the inner container having a bottom and a side extending peripherally around the bottom and terminating in an open top end; and a cover removably attached to the upper end, wherein the cover fits over and around the upper end of the outer container to enclose the inner container;

wherein the side includes an upper portion, an intermediate portion, and a lower portion, wherein the lower portion of the side has a smaller diameter than the intermediate portion of the side, and wherein the intermediate portion of the side has a smaller diameter than the upper portion of the side;

wherein the side includes an annular first side ledge formed between the upper portion of the side and the intermediate portion of the side, and an annular second side ledge formed between the intermediate portion of the side and the lower portion of the side; and wherein the inner container is securely retained by the top end against the cover, by the bottom against the interior bottom, and by one of the first annular side ledge and the second annular side ledge against the inner wall ledge.

2. The insulating beverage container of claim 1, wherein the inner wall ledge engages one of the first side ledge and the second side ledge.

3. The insulating beverage container of claim 1, wherein one of the first side ledge and the second side ledge is supported by the inner wall ledge.

4. The insulating beverage container of claim 1, wherein the side extends above the upper end.

5. The insulating beverage container of claim 1, wherein the cover includes a circular base and cylindrical sidewall extending generally upwards from the circular base to a top surface.

6. The insulating beverage container of claim 5, wherein the top surface includes an aperture having a diameter smaller than the upper end of the inner container.

7. The insulating beverage container of claim 6, wherein the aperture is sized to pass at least a portion of a beverage can or beverage bottle.

8. The insulating beverage container of claim 6, wherein the aperture is a first aperture, and wherein the top surface further includes a hinged closure arranged to transition between a closed configuration wherein the hinged closure seals the first aperture and an open configuration.

9. The insulating beverage container of claim 8, wherein the top surface includes a raised rim that extends partially around a perimeter of the top surface.

10. The insulating beverage container of claim 9, wherein, when in the closed configuration, the hinged closure mechanically engages the raised rim.

11. The insulating beverage container of claim 8, further comprising a second aperture, and wherein the top surface further includes a flexible closure arranged to transition between a closed configuration wherein the flexible closure seals the second aperture and an open configuration.

12. The insulating beverage container of claim 1, wherein the bottom of the inner container is a perforated bottom.

13. The insulating beverage container of claim 12, wherein the perforated bottom is sized to receive and support a beverage can or beverage bottle of a first diameter, wherein the second side ledge is sized to receive and support a beverage can or beverage bottle of a second diameter, and wherein the first side ledge is sized to receive and support a beverage can or beverage bottle of a third diameter, wherein the third diameter is larger than the second diameter, and wherein the second diameter is larger than the first diameter.

14. The insulating beverage container of claim 13, wherein the interior bottom is sized to receive and support a beverage can or beverage bottle of the third diameter when the inner container is removed from the outer container.

* * * * *